United States Patent [19]

Packer

[11] 4,039,422

[45] Aug. 2, 1977

[54] METAL RECOVERY UNIT

[76] Inventor: Elliot L. Packer, 1015 Prospect Ave., Plainfield, N.J. 07060

[21] Appl. No.: 622,228

[22] Filed: Oct. 14, 1975

[51] Int. Cl.[2] ..... C25C 1/20; C25C 7/00; C25C 7/02

[52] U.S. Cl. ..... 204/272; 204/269; 204/275; 204/284

[58] Field of Search ..... 204/272, 266, 284, 222, 204/259, 263, 269, 275

[56] References Cited

U.S. PATENT DOCUMENTS

| | | | |
|---|---|---|---|
| 820,113 | 5/1906 | Hinkson | 204/272 X |
| 1,440,091 | 12/1922 | Long | 204/272 |
| 2,228,264 | 1/1941 | Freedley | 204/266 |
| 2,275,194 | 3/1942 | Sizelove | 204/284 |
| 2,643,223 | 6/1953 | Notvest | 204/284 X |
| 3,481,857 | 12/1969 | Gray | 204/272 |
| 3,507,770 | 4/1970 | Fleming | 204/272 |

*Primary Examiner*—Arthur C. Prescott

*Attorney, Agent, or Firm*—McAulay, Fields, Fisher & Goldstein

[57] ABSTRACT

A unit for the recovery and removal of metal from solution employing a series of concentric cylindrical wire mesh electrodes. Alternating concentric electrode elements are connected to one another to provide interleaved anode and cathode elements. The cathode is a relatively fine wire mesh that is sandblasted to provide maximum cathode surface area. The electrode arrangement is held and positioned within a cylindrical container by a base plate having a series of annular concentric grooves into which the bottom edges of the electrode elements are received. The base plate stands up off the floor of the container to provide a shallow chamber between the base plate and a central inlet opening to the container. A plurality of holes in the base plate admit fluid from the chamber into the annular channels between the electrode elements. The configuration facilitates streaming of the solution along the channels and thus along the cathode surfaces. Solution travels up the annular channels between electrode elements and out and over an upper open rim of the container.

9 Claims, 5 Drawing Figures

METAL RECOVERY UNIT

BACKGROUND OF THE INVENTION

This invention relates in general to an apparatus and technique for efficiently recovering or removing metal ions from solution.

In the plating of precious metals, such as gold and silver, much precious metal is lost in what is known as the drag out from the rinse solution. There are known techniques which are used to recover a portion of the previous metal from the rinse tank. These known techniques have the limitation that the amount of the precious metal recovered is limited so that much precious metal is lost. To put it another way, the value of the additional metal recovered does not warrant the cost of recovering substantially all of the precious metal in the rinse with the known techniques.

Accordingly, it is a major purpose of this invention to provide a technique for recovering metal from a rinse which is more efficient or more economical than are previously known techniques.

More specifically, it is a purpose of this invention to provide a metal ion recovery unit which is fairly inexpensive in construction and which, furthermore, is relatively inexpensive to operate.

Thus, it is a purpose of this invention to provide a metal recovery unit which is sufficiently efficient that it can be economically used to recover virtually all of the metal in a solution.

In addition to the value of the metal recovered from precious metal plating processes, there is the environmental need for recovery of metal in all types of metal finishing operations so that the metal, be it a precious metal or a base metal, is not flushed down into the sewers. Indeed, there are various legal requirements which many metal finishing operations have to meet to minimize the amount of metal flushed into the sewage system.

Accordingly, it is an important and related purpose of this invention to provide a metal ion removal system that can be adapted to use with a wide range of metals, both precious and base, so that the recovery unit can be used not only to recover valuable metals but also to remove metal from solution to minimize the pollution created by metal finishing plants.

In metal finishing operations, it is desirable that the metal recovery unit be as compact as possible. In general, space requirements in most metal finishing operations prohibit the use of a large recovery unit. Accordingly, it is another purpose of this invention to provide a compact metal recovery unit.

As indicated above, it is important that a metal recovery unit be as efficient as possible, as compact as possible and operate to recover as much as the metal as possible. But these three operating parameters are to some extent contradictory. For example, it is relatively inefficient to recover the last portion of the metal from a solution. Furthermore, a compact system tends to be less effective in the removal of metal. But there is usually a trade-off between these parameters.

Accordingly, it is a purpose of this invention to provide a metal recovery unit which has a structure and operating mode that not only optimizes the trade-off between these parameters but also makes the trade-off less critical so it is possible to provide substantially complete metal recovery while not sacrificing efficiency and compactness very greatly.

BRIEF DESCRIPTION

In brief, the presently preferred embodiment of this invention employs a waterproof cylindrical container having an inlet at one end and an outlet at the other end. Within this container, there are deployed a series of concentric cylindrical electrode elements. Alternate elements are electrically connected together to provide an anode structure and a cathode structure. This electrode assembly is mounted within the circular container so that the container is concentric with the set of concentric cylindrical electrode elements. The solution is pumped into an inlet opening at the center base of the container and flows up through the container between the electrodes. Adjacent electrodes thus form annular passageways or channels through which the solution flows.

A direct current low voltage is applied across the anode and cathode structure to plate the metal out on the cathode. The solution flows out over the top of the container after having passed upward through the annular channels between the electrode elements. Because there are a plurality of cathode elements and a plurality of anode elements, there are a plurality of channels through which the solution flows and the surfaces on both sides of the cathode elements are employed to maximize cathode area and to increase the efficiency of the recovery operation in as compact a space as possible.

The electrode elements are highly perforated, wire mesh being used for the cathode to provide large cathode surface area. It is particularly important that the cathode surface area be as large as possible. Accordingly, the wire mesh cathode elements are sand blasted so as to further increase cathode surface area.

The electrode elements are supported on a plastic base plate which stands up off the container bottom to provide a shallow chamber between base plate and container bottom. The bottom edges of the cylindrical electrode elements are supported in and positioned by circular grooves in the base plate. Openings in the base plate permit solution flow from the shallow chamber into the channels between the electrode elements.

BRIEF DESCRIPTION OF THE DRAWINGS

FIG. 2 is taken along a vertical plane in FIG. 1.

DESCRIPTION OF THE PREFERRED EMBODIMENTS

Figure 1:
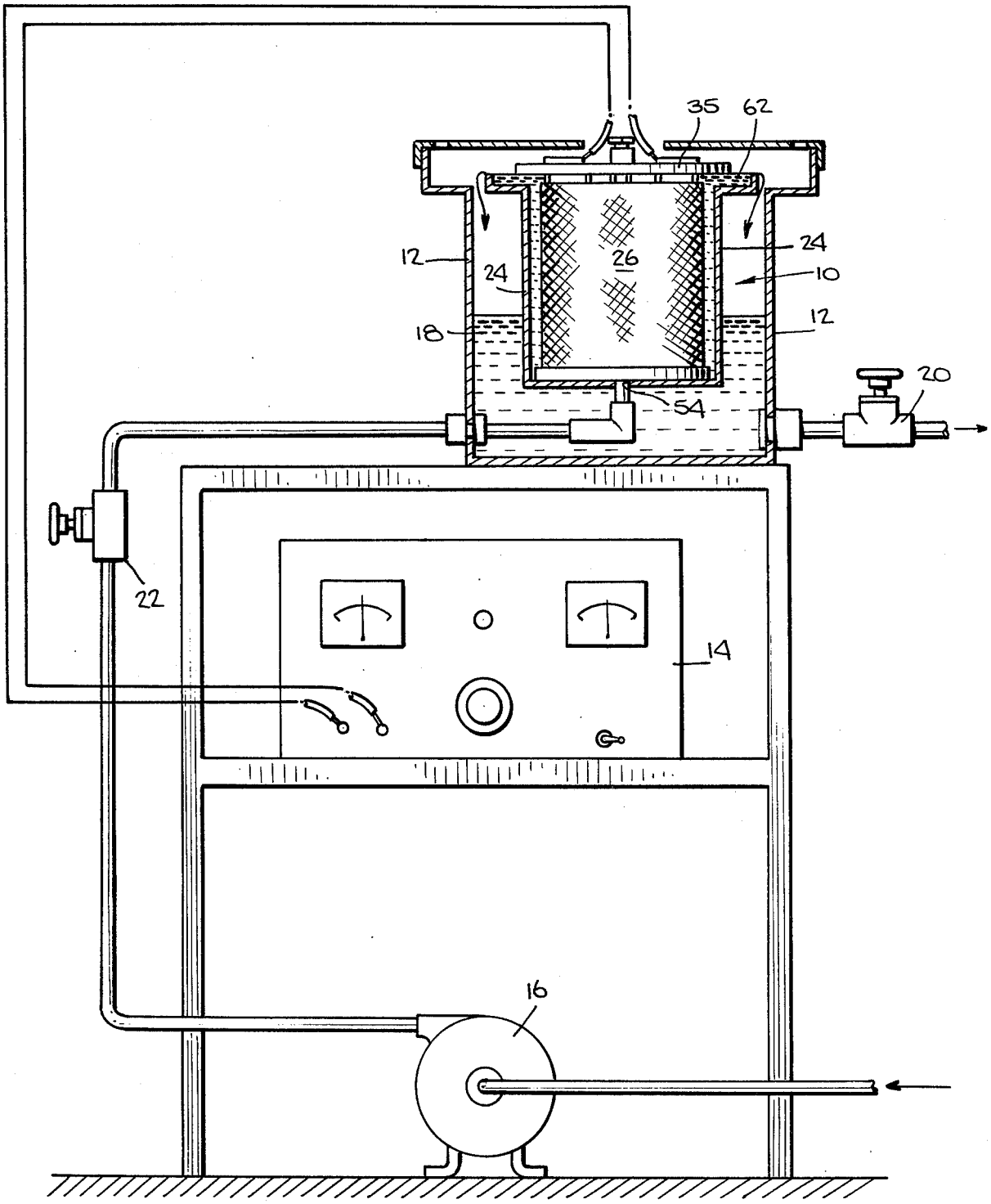
FIG. 1 is a mechanical schematic showing the relationship between one embodiment of the metal recovery unit of this invention and associated units such as an overflow container, power supply, inlet pump and control valves.

The FIGS. all relate to the same embodiment. As shown in FIG. 1, the recovery unit 10 itself is supported within a larger overflow tank 12. A power supply 14 provides direct current voltage to the recovery unit 10. A pump 16 pumps solution from a rinse tank (not shown) into the bottom of the recovery unit 10. The recovery unit 10 has a single central opening 54 through which the metal ion containing solution is pumped into the recovery unit. After having passed through the recovery unit, the solution overflows from an open edge at the top of the recovery unit 10 into the overflow tank 12. The solution 18 can then be reused in the rinse tank by opening the valve 20 at the base of the overflow tank 12. An inlet valve 22 is shown and is opened when the recovery unit 10 is put into operation.

As can best be seen in FIGS. 2 through 5, the recovery unit 10 includes a container 24 within which the electrode elements are disposed. In this embodiment, the container 24 is cylindrical as are the electrode elements.

In the embodiment shown, three concentric cylindrical wire mesh cathode elements 26, 27, 28 are electrically connected to one another through six metal brackets 30, six metal bolts 31, two metal straps 32 and a jumper wire 33 connecting the two straps 32. The structure operates as a cathode and is mounted to an insulating carrier disc 35. The arrangement that constitutes the anode includes two concentric cylindrical expanded metal or mesh elements 38 and 39. These two elements are electrically interconnected by four metal brackets 40, four metal bolts 41, two metal straps 42 and a jumper wire 43 connecting the two straps 42.

Leads 46 and 47 then connect the electrodes to the DC power supply 14.

An insulating, plastic, base plate 50 has a series of concentric grooves 52 on its upper surface into which the lower edges of the five electrode elements 26, 27, 28, 38 and 39 fit and thus are positioned. This base plate 50 has an outer rim which extends down a small amount so that the base plate 50 stands up off the floor of the container 24. Thus, a solution pumped in through the inlet 54 will spread out beneath the base plate 50 and pass up through the numerous openings 56 in the base plate 50. The top plate 35, like the base plate 50, is a plastic electrical insulating plate and serves to carry and to position the upper edges of the five electrode elements. This top plate 35 is supported and positioned by a plastic, insulating central post 58 which supports the top plate 35 to the base plate 50 as well as positioning the top plate 35.

The cathode and anode elements are alternately positioned to provide a uniform field gradient and thus a uniform current density. Furthermore, the outer element 26 is a cathode element so that, in this embodiment of five elements, the greatest possible surface area can be provided for the cathode. The greater the surface area of the cathode the more efficient will be the system.

Specifically, by efficiency is meant cathode efficiency, which is a figure of merit that relates to the rate at which metal is removed. Cathode efficiency as commonly used commercially is measured in grams per ampere-hour. Thus the greater the cathode efficiency, the greater the rate at which the metal is plated out from solution. In this commercial usage, cathode efficiency is a function of the metal being plated out and is very much a function of the concentration of the metal. For example, for gold, cathode efficiency may vary from a figure of 7.2 grams per ampere-hour for gold having a concentration substantially greater than 1000 parts per million to 0.07 for gold having very low concentration in the order of ten parts per million. There are other process variables such as flow rate which will affect cathode efficiency. However, the configuration of the electrode structure, the relationship between electrodes, the shape and surface area of the electrodes and the total geometric configuration of the electrodes in the container within which they are supported will provide what could be termed a cathode efficiency factor. The higher the cathode efficiency factor, the higher then will be the cathode efficiency under any given set of operating conditions, such as flow rate, concentration and the nature of metal ion in solution. By contrast with the above usage, cathode efficiency is used in the academic literature as a percentage figure relating actual plating output to the theoretical maximum calculated by Faraday's law. However, reference to efficiency in this application means cathode efficiency as commercially used and defined above.

The arrangement shown of multiple element electrodes wherein each element is arranged parallel to (in this case, concentric with) adjacent electrode elements provides a series of channels 60 all of which are parallel with one another and all of which extend from the bottom of the container 24 to the top of the container 24. The inlet 54 is at the bottom of the container 24 while the outlet from the container 24 is over the top of the container 24. Thus, the metal ion containing solution must flow from the bottom of the container 24 to the top of the container 24 and will do so through these channels 60 thereby providing a flow along all of the electrode elements so that there will be maximum exposure of the solution of the electrodes. The channels 60 provided by this electrode structure aid in increasing the ion diffusion rate by increasing the streaming velocity of the solution. The result is enhanced cathode efficiency.

A main advantage of the compact arrangement shown is that it tends to maximize the ratio of cathode surface area to volume of solution being processed and such further enhances cathode efficiency.

The emphasis herein is on increasing the surface area of the cathode as much as much as possible. However, as is known, the surface area of the anode should not be too much less than the surface area of the cathode. As contrasted with parallel plate electrodes, the concentric electrode elements permit a substantial reduction in anode surface area and thus anode size while maintaining the same cathode efficiency.

Furthermore, it is desirable to use a wire mesh anode where possible so that the total anode structure can be as small as possible.

However, a fairly fine wire mesh structure for the cathode is of great importance to provide a large cathode surface area. An advantage of the wire mesh structure is that, because plating is particularly effective on an edge, the plating of one side of the cathode will result in an effective plating of the other surface of the mesh. Thus the outer and inner cathode elements 26 and 28 will have their respective outwardly facing and inwardly facing surface plated as well as the surface facing an anode element simply because of the mesh arrangement. Not only does the wire mesh design automatically provide a larger surface area but it also makes it possible to provide the outer and inner electrode elements as part of the cathode yet have both sides of those elements effective as plating surfaces. Having the outer and inner elements 26 and 28 plated contributes appreciably toward the desired combination of efficiency and compactness.

The efficiency of the recovery unit is enhanced by providing a high ratio of cathode surface area to volume of solution in the unit. Accordingly, the channels 60 are as narrow as possible relative to their length. In particular, it is important, from the point of view of efficiency, that the axial length of these channels 60 be at least an order of magnitude greater than the width of each channel. The use of the base plate 50 aids in achieving this result because the grooves 52 provide support and positioning for the wire mesh electrode elements and thus, make it possible to design placing these electrode elements as close as possible to one another without risking electrical contact.

The support plate 50 has a structure which aids in the uniform distribution of flow of the solution through the recovery unit. Uniform distribution of flow is a further factor which enhances efficiency. Not only does the plate 50, by positioning the electrode elements, control the width of the channels 60 but the plate 50 through the graduated openings 56 assures that within each channel the flow rate will be fairly uniform. Thus, the openings 56 in the inner channels are smaller than in the outer channels in order to maintain an approximately constant ratio of opening space to channel cross section and thus maintain a uniform flow distribution throughout the entire recovery unit.

Figure 2:
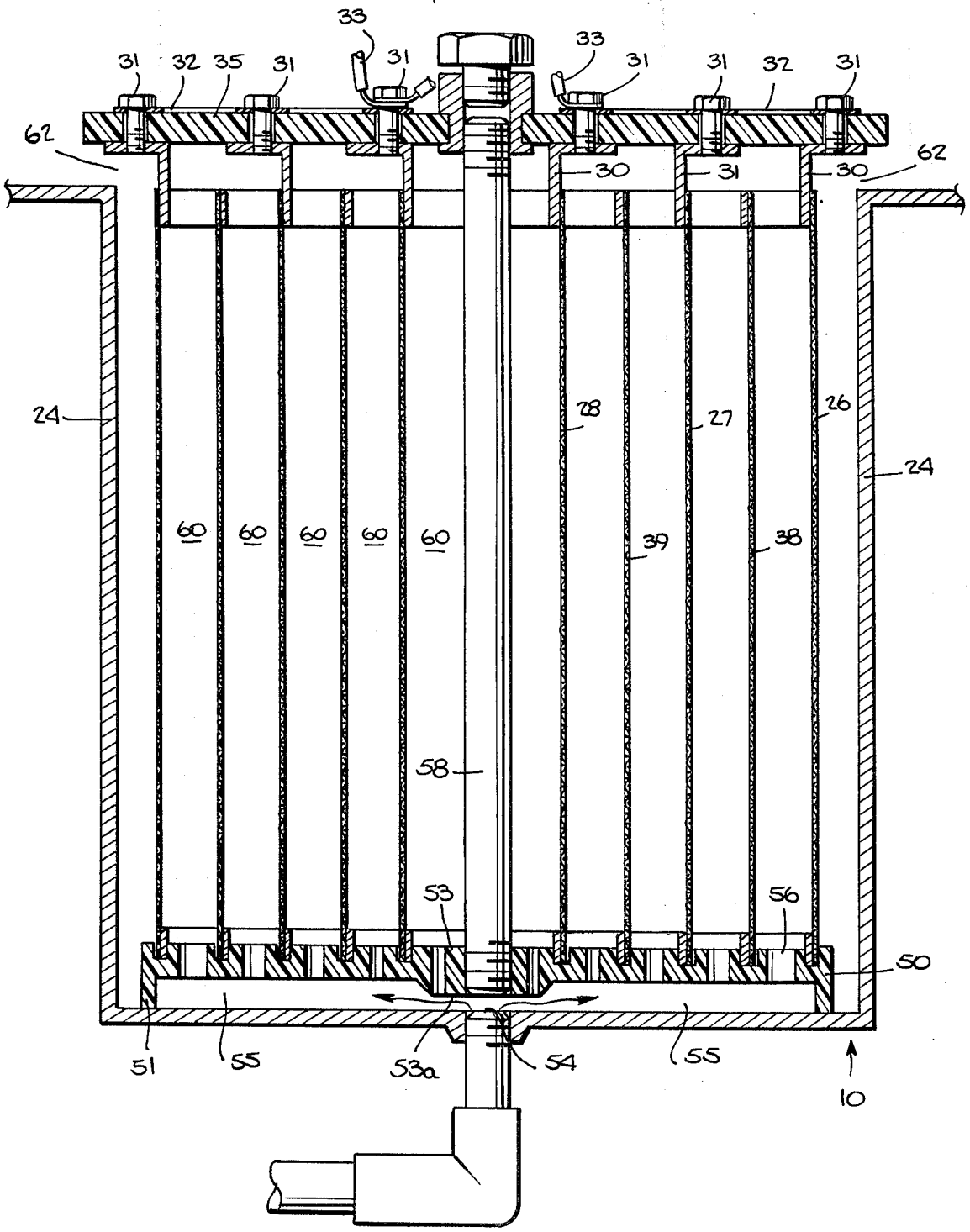
FIG. 2 is a longitudinal cross section of the embodiment of the recovery unit shown in FIG. 1.
Figure 3:
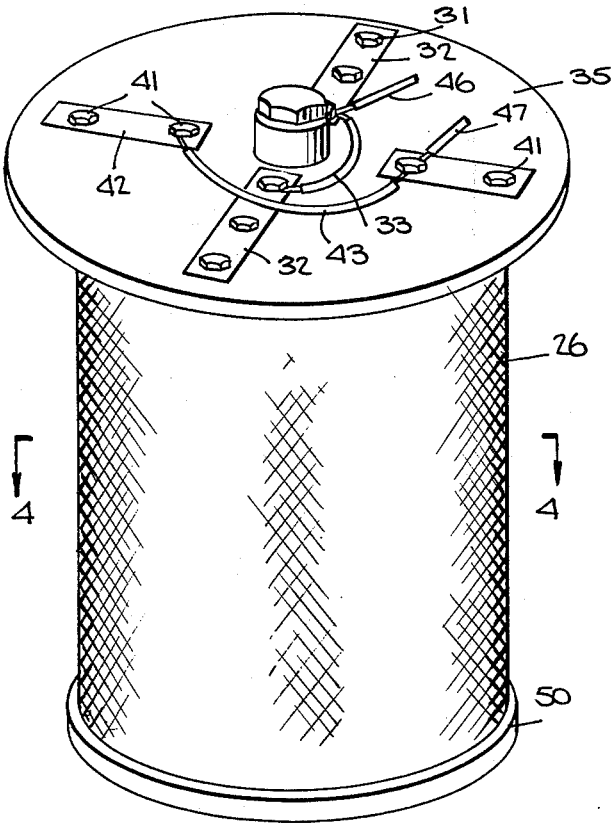
FIG. 3 is a perspective view of the FIG. 2 recovery unit with the container stripped away.
Figure 4:
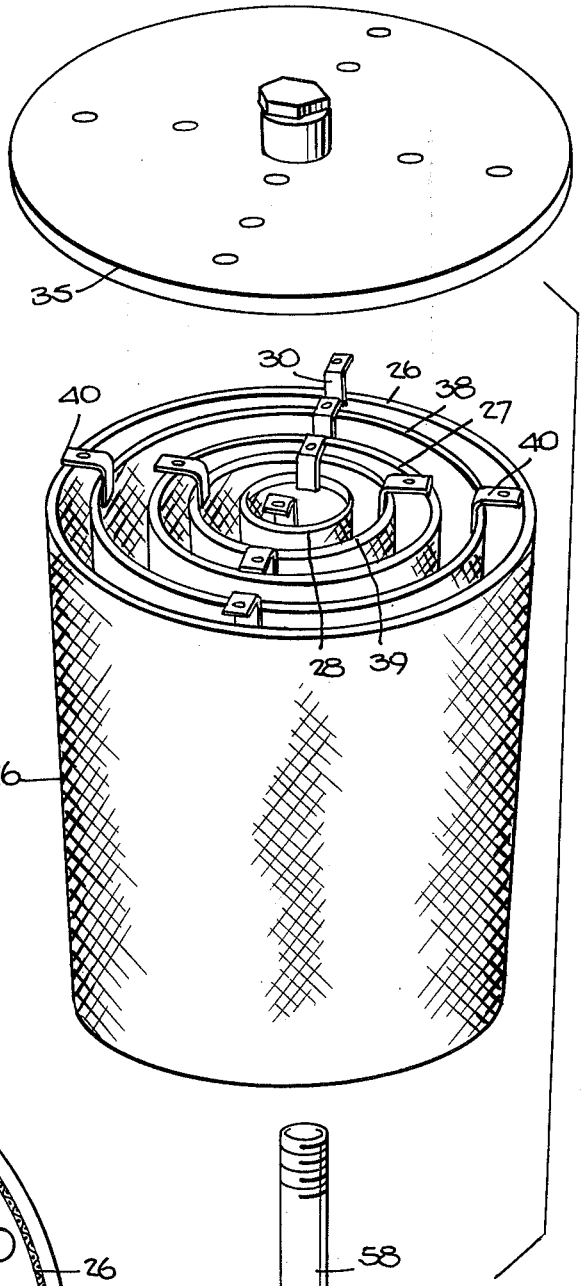
FIG. 4 is a transverse cross-sectional view along the line 4—4 through FIG. 3.
Figure 4:
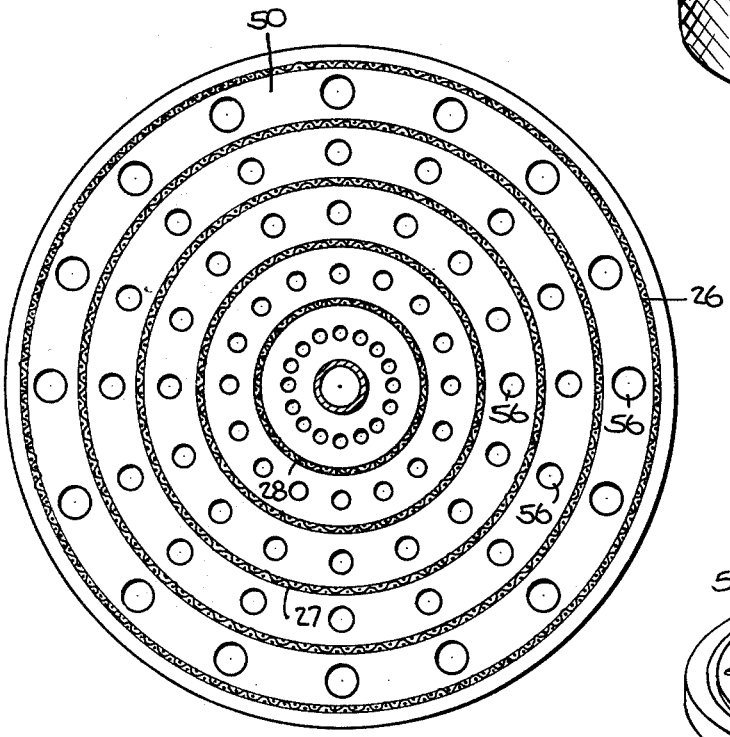
Figure 5:
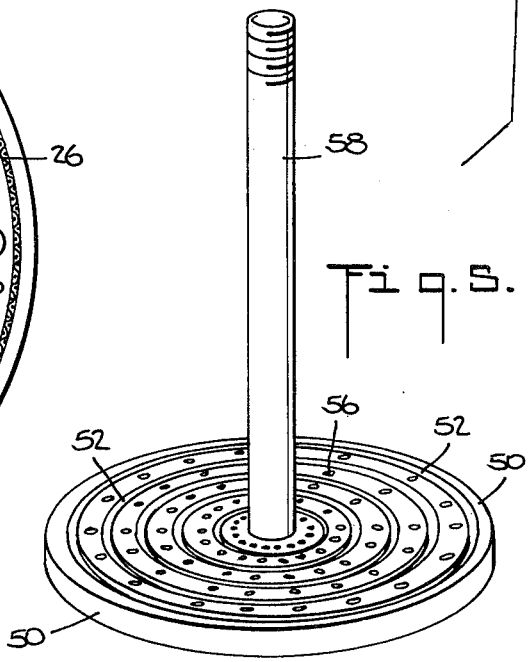
FIG. 5 is an exploded view of the apparatus shown in FIG. 3.

In addition, as may best be seen in FIG. 2 the center portion 53 of the plate 50 extends below the lower surface of the rest of the plate so that the incoming solution strikes a wall 53*a* which causes the incoming solution to be deflected radially throughout the space 55 under the plate 50. This tends to provide a ready flow to all the openings 56 and thus, to each of the channels 60.

If there are applications where the recovery unit disclosed herein is to be used with certain of the electrode elements removed, then dummy plastic elements should be inserted in order to maintain the rapid flow along the channels 60.

The channels 60 in one embodiment are one inch wide by twelve inches long. The narrow channel arrangement provides a high streaming velocity so that a high ion diffusion rate is obtained and so that a high ion transport rate is also obtained.

In general, the effect of this plate 50 is to aid in providing as compact an arrangement as possible. The purpose of a compact arrangement is to, in turn, provide a maximum ratio of cathode surface area to volume of solution being processed. The ultimate result is enhanced efficiency.

As shown, the outflow from this recovery unit 10 is through an annular radially outward opening 62 at the top of the unit 10. An advantage to this arrangement is that there is minimum hydraulic resistance provided in the system and thus, the entire system need not be designed to accommodate higher pressures that might be necessary for higher flow rates if a single central outlet opening were provided.

The metal brackets, bolts and straps to which the electrode elements are connected should be plated with a metal commensurate with the operation of the system. In particular, they should be placed with metals that will not be attached by the electrolyte. Generally metal adhesion and cathode efficiency is enhanced when the cathode is composed of or is initially flashed with the metal to be recovered. In one embodiment where the cathode was flashed with gold prior to being used to recover gold, the brackets 30, bolts 31, and straps 32 were also flashed with gold.

Up to a certain point, the faster the solution moves across the electrode surfaces, the greater will be the efficiency and the more metal will plate out. Part of the reason for this is that the moving solution brushes off minute gas bubbles and in general, prevents the depolarizing of the electrode. Another partial reason for the result is that the plating out is a diffusion controlled reaction and the quicker the layer of water from which metal has been removed is replaced at the cathode surfaces, the more efficient is the operation. In the embodiment disclosed, a pump providing a throughput of five to eight gallons per minute provided a very satisfactory result.

In the embodiment illustrated in the FIGS., it was possible to reduce a concentration of 540 parts of gold ions per million of solution to something less than one (1) part per million in an overnight continuous circulation of solution through the recovery unit. In this embodiment, the solution was approximately 30 gallons, the recovery unit had a capacity of 5 gallons and the flow rate was such that the entire 30 gallons were processed through the recovery unit approximately once every six minutes. Accordingly, the reduction in concentration to substantially a negligible amount occurred in less than 120 cycles through the recovery unit. In that test, the current level was at approximately 2 amperes.

Using the same recovery unit, in a typical gold plating installation, the final thirty gallon rinse tank was circulated through the unit on a continuing basis during the working day. Measurements showed that nearly 5 grams of gold was introduced to the rinse tank each hour. Nevertheless the recovery unit 10 maintained gold concentration in the rinse tank at less than 1 part per million at all times during the day. Again, the current level employed with 2 amperes. When the current level was reduced to one ampere, there were times, while the rinse tank was most actively used, when the concentration in the rinse tank went up to nearly 10 parts per million. During lunch break and less active times during the day, the rinse tank rapidly went down to under 1 part gold per million parts solution.

Metal may be removed from solution at a faster rate by increasing the current density. This results in a powdery deposit which flakes off the cathode and is difficult to recover. Thus it is desirable to keep the current density relatively low rather than trying to increase the rate of recovery by increasing current density. In cases where the main goal is metal recovery, and not just metal removal, current density has to be kept below certain levels to assure that just the metal to be recovered is plated out.

In one embodiment that has been built and tested, diameter dimensions were substantially as follows: the tank 24 was 11½ inches, the electrode element 26 was 10½ inches, the electrode element 38 was 8½ inches, the electrode element 27 was 6½ inches, the electrode element 39 was 4½ inches, and the electrode element 28 was 2½ inches. Thus the channels 60 were somewhat less than one inch wide; after taking into account an effective thickness for each of the electrode elements. The overflow tank 12 was square in cross section and as small as possible. Thus its inner dimension was approximately 11½ inches. The circular flange of the container 24 rested on the square shoulder of the tank 12. FIG. 1 shows the relationship between the container 24 and the tank 12 somewhat as it would appear in a section at the corner of the tank 12 thereby showing the space through which the solution flows down into the tank 12.

Of course, it should be recognized that the perforated electrode elements provide for solution flow throughout. Indeed, because the electrode elements are perforated, the solution can flow from channel to channel. It is believed, the cathode mesh structural feature aids in enhanced cathode efficiency in part because of the ability of the solution to flow through the mesh openings. However, the dominant direction of flow is along the surface of the electrodes. In that embodiment the length of the electrodes was approximately 12 inches.

The material of the electrode is a function, in part, of the nature of the solution, including its pH, and the type of metal which is to be removed from solution. In the embodiment which has been constructed and tested in a gold recovery unit, the anodes were platinized titanium. They were constructed of an expanded metal to provide the porous anode structure; a wire mesh of platinized titanium not being available. The cathode was a gold-flashed stainless steel 8 by 8 mesh (that is, having 8 wires to the inch) in which the wire were 0.047 inches in diameter.

The technique of sand blasting the cathode is a known technique and was used in order to generate a greater cathode surface area. A preferred sand blasting is to use both fine (No. 00) and coarse (No. 1) sand. The coarse sand creates deep pitting. The find sand causes pitting between deeper pits; that is, picks up areas the coarse sand misses. It is preferable to pit to the point where a dull surface is provided with no visible bright spots. Sand blasting can provide approximately a doubling of surface area and thus of cathode efficiency.

In use, where the major purpose of the unit is to recover a precious metal such as gold from a rinse tank and to prevent the loss of gold through the drippings from the gold plated product as it is taken out of the rinse tank, the solution which overflows from the recovery unit can be fed back to the rinse tank and reused. As the objects to be plated are pulled out of the rinse tank and moved on for further processing, some rinse tank solution inevitably drops onto the floor as a waste which is called "drag-out". Any gold in the drag-out is lost and thus there is an economic loss to the processor. In addition, it is washed out into the disposal and sewage system thereby creating pollution. By means of this recovery unit the rinse tank metal concentration can be kept to such a small amount, well under one part per million, that the drag-out is for all practical purposes free of contamination and free of lost gold.

Where the unit is used less for the value of the recovered metal and more to prevent pollution and contamination, the solution from the recovery unit may or may not be returned to the last processing stage. In many cases, the solution may be disposed of. But because the solution is substantially free of the metal involved in the finishing operation, the solution can meet environmental protection standards and can be disposed of with minimum polluting effect.

In either case, where the ion concentration is very low or becomes low, a salt such as disodium phosphate must be added to maintain conductivity.

I claim:

1. A recovery unit for recovering metal from a solution containing metal ions, said unit comprising:

a container, a first electrode within said container, and adapted to be connected and used as an anode, said first electrode including at least one perforated element, a second electrode within said container and adapted to be connected and used as a cathode, said second electrode including a plurality of spaced apart highly perforated electrode elements providing a large cathode surface area, said electrode elements all being disposed substantially parallel to each other to provide a plurality of parallel channels within said container, said container having an inlet opening in communication with one end of each of said parallel channels and an outlet opening in communication with the other end of each of said parallel channels, said openings and said channels having a relationship such that liquid flowing through said inlet opening to said outlet opening will branch out and flow through all of said channels in parallel.

2. The recovery unit of claim 1 wherein said cathode elements are a plurality of concentric, cylindrical elements and wherein said anode includes at least one cylindrical element concentric with said cathode elements.

3. The recovery unit of claim 2 further comprising:

a circular base plate having an annular depending outer ridge, said base plate being seated at the bottom of the container on said ridge.

said ridge of said base plate providing a shallow chamber beneath said base plate.

said shallow chamber being in communication with said inlet, said base plate having a plurality of concentric circular grooves in its upper surface, lower edges of said electrode elements being positioned in respective ones of said grooves, a plurality of openings through said base plate between said grooves to permit circulation of solution from said shallow chamber through said grooves into said channels.

4. The recovery unit of claim 3 wherein said outlet is an annular opening at the upper edge of the side wall of said container, whereby flow of solution is from the centrally disposed inlet port upward through said unit and outward over the edge of said side wall of said container.

5. The metal recovery unit of claim 1 wherein:

said cathode is a sandblasted mesh, thereby providing a large surface area.

6. The metal recovery unit of claim 2 wherein:

said cathode is a sandblasted mesh, thereby providing a large surface area.

7. The metal recovery unit of claim 3 wherein:

said cathode is a sandblasted mesh, thereby providing a large surface area.

8. The metal recovery unit of claim 4 wherein:

said cathode is a sandblasted mesh, thereby providing a large surface area.

9. A system for recovering metal from a solution containing metal ions comprising:

a source of metal in solution, a container in communication with said source to receive a flow of solution from said source, a first electrode within said container, and adapted to be connected and used as an anode, said first electrode including at least one perforated element, a second electrode within said container and adapted to be connected and used as a cathode, said second electrode including a plurality of spaced apart highly perforated electrode elements providing a large cathode surface area, said electrode elements sall being disposed substantially parallel to each other to provide a plurality of parallel channels within said container, said container having an inlet opening in communication with one end of each of said parallel channels and an outlet opening in communication with the other end of each of said parallel channels, said openings and said channels having a relationship such that liquid flowing through said inlet opening to said outlet opening will branch out and flow through all of said channels in parallel, and means connected between said source and said openings of said container to circulate solution through said container from said inlet opening to said outlet opening and back to said source.

* * * * *

UNITED STATES PATENT AND TRADEMARK OFFICE

CERTIFICATE OF CORRECTION

PATENT NO. : 4,039,422

DATED : August 2, 1977

INVENTOR(S) : Elliot L. Packer

It is certified that error appears in the above-identified patent and that said Letters Patent are hereby corrected as shown below:

Col. 1, line 12, change "previous" to --precious--.
Col. 1, line 55, change "as" second occurrence, to -- of --.
Col. 4, line 28, change "of" second occurrence, to --to--.
Col. 4, line 36, change "such" to --thus--.
Col. 4, line 38, delete "as much" first occurrence.
Col. 5, line 49, "unit 10" should read --container 24--.
Col. 5, line 58, change "placed" to --plated--.
Col. 5, line 59, change "attached" to --attacked--.
Col. 6, line 32, change "with" to --was--.
Col. 7, line 18, "wire" should read --wires--.
Col. 7, line 24, change "find" to --fine--.
Col. 8, line 66, in Claim 9, "sall" should read --all--.
Fig. 2, change reference numeral "31" for the metal bracket on the upper right hand side to --30-- in conformity with the adjacent brackets.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*